US006660992B2

(12) United States Patent
Yang

(10) Patent No.: US 6,660,992 B2
(45) Date of Patent: Dec. 9, 2003

(54) LABEL-SENSING DEVICE FOR A LABELING MACHINE

(76) Inventor: Sheng-Hui Yang, No. 2, Lane 64, Tung-Kuang-Yuan Rd., Tung Dist., Taichung City (TW)

( * ) Notice: Subject to any disclaimer, the term of this patent is extended or adjusted under 35 U.S.C. 154(b) by 124 days.

(21) Appl. No.: 09/767,780

(22) Filed: Jan. 23, 2001

(65) Prior Publication Data

US 2002/0096628 A1 Jul. 25, 2002

(51) Int. Cl.[7] ..... G06M 7/00
(52) U.S. Cl. ..... 250/221
(58) Field of Search ..... 250/559–565, 250/559.19, 559.27

(56) References Cited

U.S. PATENT DOCUMENTS 4,239,570 A 12/1980 Kerwin
4,294,644 A 10/1981 Anderson
4,585,506 A 4/1986 Matsuguchi
4,620,887 A 11/1986 Kontz et al.
4,647,333 A 3/1987 Voltmer et al.
RE33,579 E 4/1991 Voltmer et al.
5,256,239 A 10/1993 Voltmer et al.
5,269,864 A 12/1993 Otruba
5,331,394 A * 7/1994 Shalon et al. ..... 356/124
5,427,029 A 6/1995 Dumke
5,486,063 A * 1/1996 Fox et al. ..... 250/559.27
5,730,816 A 3/1998 Murphy
5,785,798 A 7/1998 Horsman et al.
5,798,020 A 8/1998 Coughlin et al.
5,810,955 A 9/1998 Seifert et al.

* cited by examiner

*Primary Examiner*—Tu T. Nguyen
(74) *Attorney, Agent, or Firm*—Harness, Dickey & Pierce, P.L.C.

(57) ABSTRACT

In a label-sensing device that detects movement of a label reel during a label-feeding operation of a labeling machine, an infrared transmitter generates a sensing light output with an intensity that corresponds to a predetermined regulated DC voltage output that is supplied by a power supplying circuit. The sensing light output is directed by the transmitter so as to pass through one end of the label reel before being received by an infrared receiver. The receiver has a detected output with a weaker first intensity upon detection of a first portion of the label reel where a label overlaps with a backing paper strip, and with a stronger second intensity upon detection of a second portion of the label reel where no label overlaps with the backing paper strip. A voltage amplifier amplifies the detected output of the receiver. A controller converts the output of the voltage amplifier into a corresponding detected value, and compares the detected value with an initial reference value to determine which of the first and second portions of the label reel was sensed by the receiver.

2 Claims, 5 Drawing Sheets

LABEL-SENSING DEVICE FOR A LABELING MACHINE

BACKGROUND OF THE INVENTION

1. Field of the Invention

The invention relates to a label-sensing device for a labeling machine, more particularly to a label-sensing device that can be adjusted to suit the actual ambient light condition.

2. Description of the Related Art

Commodities, such as beverage bottles, drug bottles, containers, and packaging boxes, are generally provided with a label to classify products, to indicate usage and other information, to display the trademark or logo of the manufacturer, etc. With the recent advancement in automation, automated attachment of labels to such commodities has taken the place of manual label attachment, and has become quite popular in the industry.

Referring to FIG. 1, a conventional label-sensing device for detecting movement of a label reel during a label-feeding operation of a labeling machine is shown to comprise a controller 1, a digital-to-analog (D/A) converter 2 coupled to the controller 1, a buffer 3 coupled to the D/A converter 2, an infrared sensor 4 coupled to the buffer 3, and a comparator circuit 5 coupled to the infrared sensor 4 and the controller 1. The controller 1 provides a binary-encoded signal to the D/A converter 2. According to the binary-encoded signal from the controller 1, the D/A converter 2 generates a corresponding analog voltage that is provided to the buffer 3. The infrared sensor 4 receives the analog voltage from the buffer 3, and generates a sensing light output having an intensity that corresponds to the analog voltage. The comparator circuit 5 receives a detected output from the infrared sensor 4, and compares the detected output with a predetermined reference voltage. The result of the comparison is provided to the controller 1 by the comparator circuit 5.

FIG. 2 is a schematic electrical circuit diagram of the conventional label-sensing device of FIG. 1. As shown, the D/A converter 2 has eight input pins (XD0–XD7) coupled to the controller 1. Thus, the controller 1 can provide 256 combinations of the binary-encoded signal to the D/A converter 2, thereby enabling the latter to generate 256 different analog voltages. A transmitter side of the infrared sensor 4 receives the analog voltage from the D/A converter 2 via the buffer 3. Thus, the intensity of the sensing light output at the transmitter side of the infrared sensor 4 depends on the magnitude of the analog voltage from the D/A converter 2. The sensing light output is directed to pass through one end of a label reel (not shown), which is being fed by a labeling machine (not shown), before being received by a receiver side of the infrared sensor 4. The label reel includes a backing paper strip and a plurality of labels releasably and successively adhered on the backing paper strip. The detected output at the receiver side of the infrared sensor 4 is weaker at portions of the label reel where the labels overlap with the backing paper strip, and is stronger at portions of the label reel where the labels do not overlap with the backing paper strip, e.g. at a clearance between each adjacent pair of the labels on the backing paper strip. The comparator circuit 5 compares the detected output from the receiver side of the infrared sensor 4 with a predetermined reference voltage that is set by resistors R22, R23 of a voltage-divider circuit, and generates a high or low logic output when the detected output is lower or higher than the reference voltage. The logic output of the comparator circuit 5 is received by the controller 1 and is recorded by the latter.

It is noted that the accuracy of the label-sensing device is affected by the actual ambient light condition. It is thus desirable to provide a label-sensing device that can be adjusted to ensure proper operation regardless of the actual ambient light condition.

SUMMARY OF THE INVENTION

Therefore, the main object of the present invention is to provide a label-sensing device for a labeling machine that can be adjusted to suit the actual ambient light condition.

According to this invention, a label-sensing device is adapted for use in a labeling machine to detect movement of a label reel during a label-feeding operation of the machine. The label reel includes a backing paper strip and a plurality of label reels releasably and successively adhered on the backing paper strip. The label-sensing device comprises a power supplying circuit, an infrared sensor, a voltage amplifier, and a controller. The power supplying circuit is adapted to supply a predetermined regulated DC voltage output. The infrared sensor includes an infrared transmitter coupled to the power supplying circuit, and an infrared receiver that forms a clearance with the infrared transmitter. The clearance is adapted to permit passage of one end of the label reel therethrough. The transmitter generates a sensing light output with an intensity that corresponds to the regulated DC voltage output. The sensing light output is directed by the transmitter so as to be adapted to pass through said one end of the label reel before being received by the receiver. The receiver has a detected output with a weaker first intensity upon detection of a first portion of the label reel where one of the labels overlaps with the backing paper strip, and with a stronger second intensity upon detection of a second portion of the label reel where the labels do not overlap with the backing paper strip. The voltage amplifier is coupled to the receiver for amplifying the detected output. The voltage amplifier generates a first signal when the detected output has the first intensity, and a second signal when the detected output has the second intensity. The controller, which is coupled to the voltage amplifier, converts the signal from the voltage amplifier into a corresponding detected value, and compares the detected value with an initial reference value to determine whether the first portion or the second portion of the label reel has passed through the clearance of the infrared sensor.

In the preferred embodiment, the controller automatically adjusts the initial reference value to be higher than the detected value corresponding to the first signal from the voltage amplifier upon detection by the controller that the initial reference value is lower than the detected value for the first signal, and to be lower than the detected value corresponding to the second signal from the voltage amplifier upon detection by the controller that the initial reference value is higher than the detected value for the second signal.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
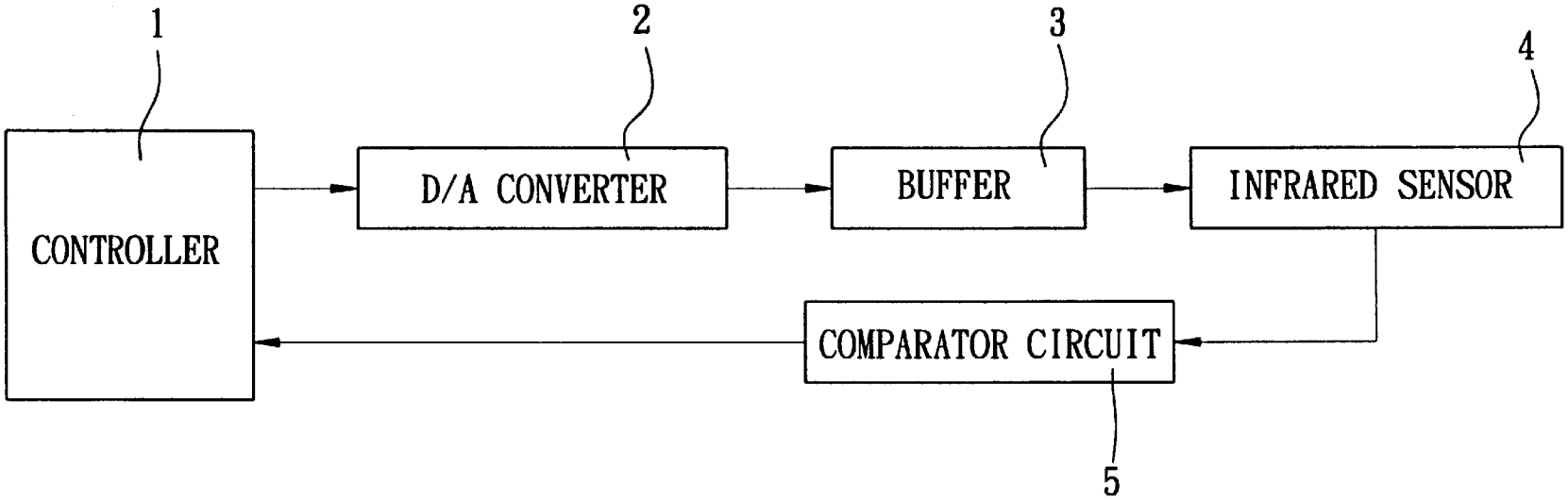
FIG. 1 PRIOR ART
FIG. 1 is a block diagram showing a conventional label-sensing device.
Figure 2:
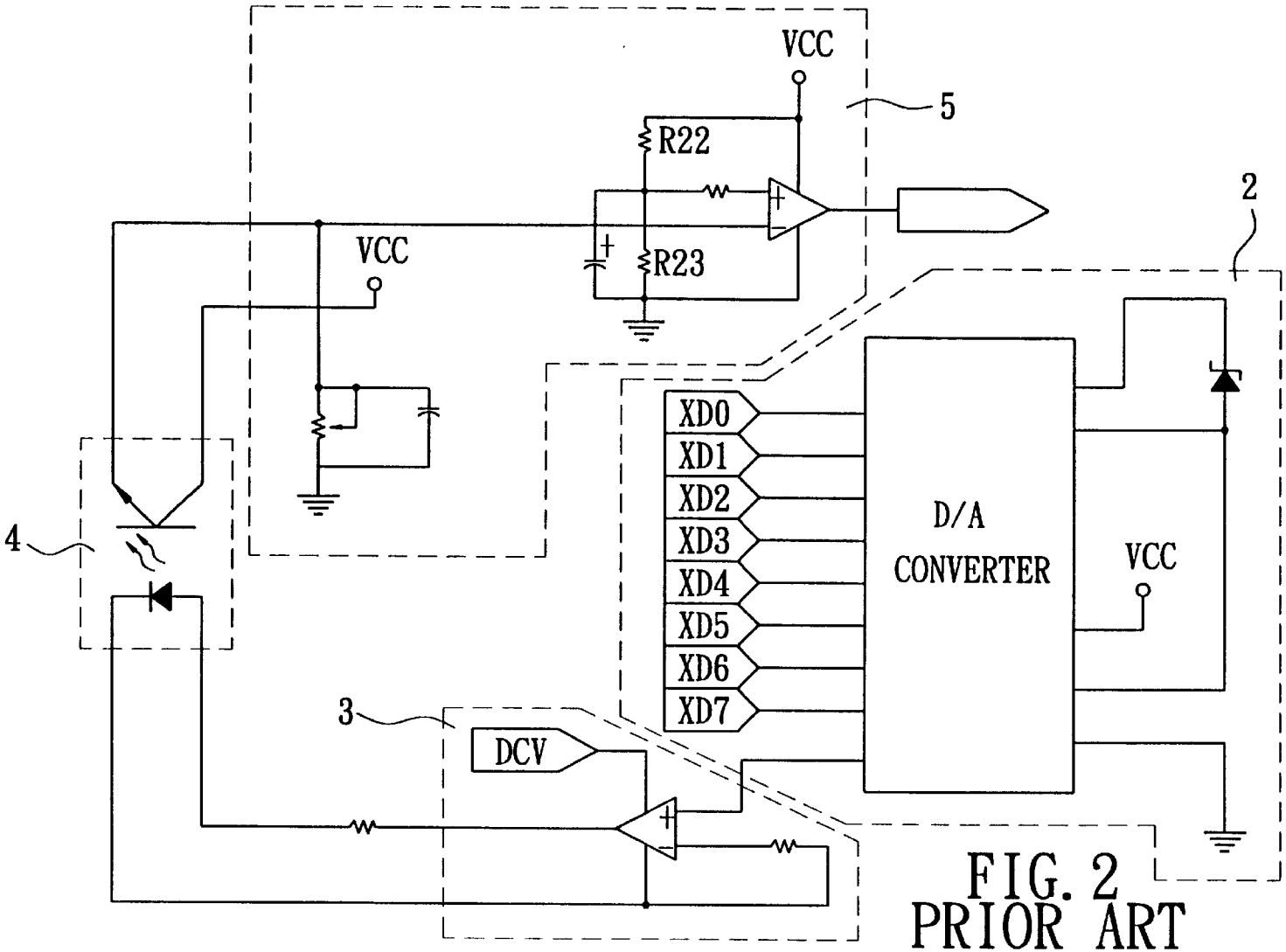
FIG. 2 PRIOR ART
FIG. 2 is a schematic electrical circuit diagram of the conventional label-sensing device of FIG. 1.
Figure 3:
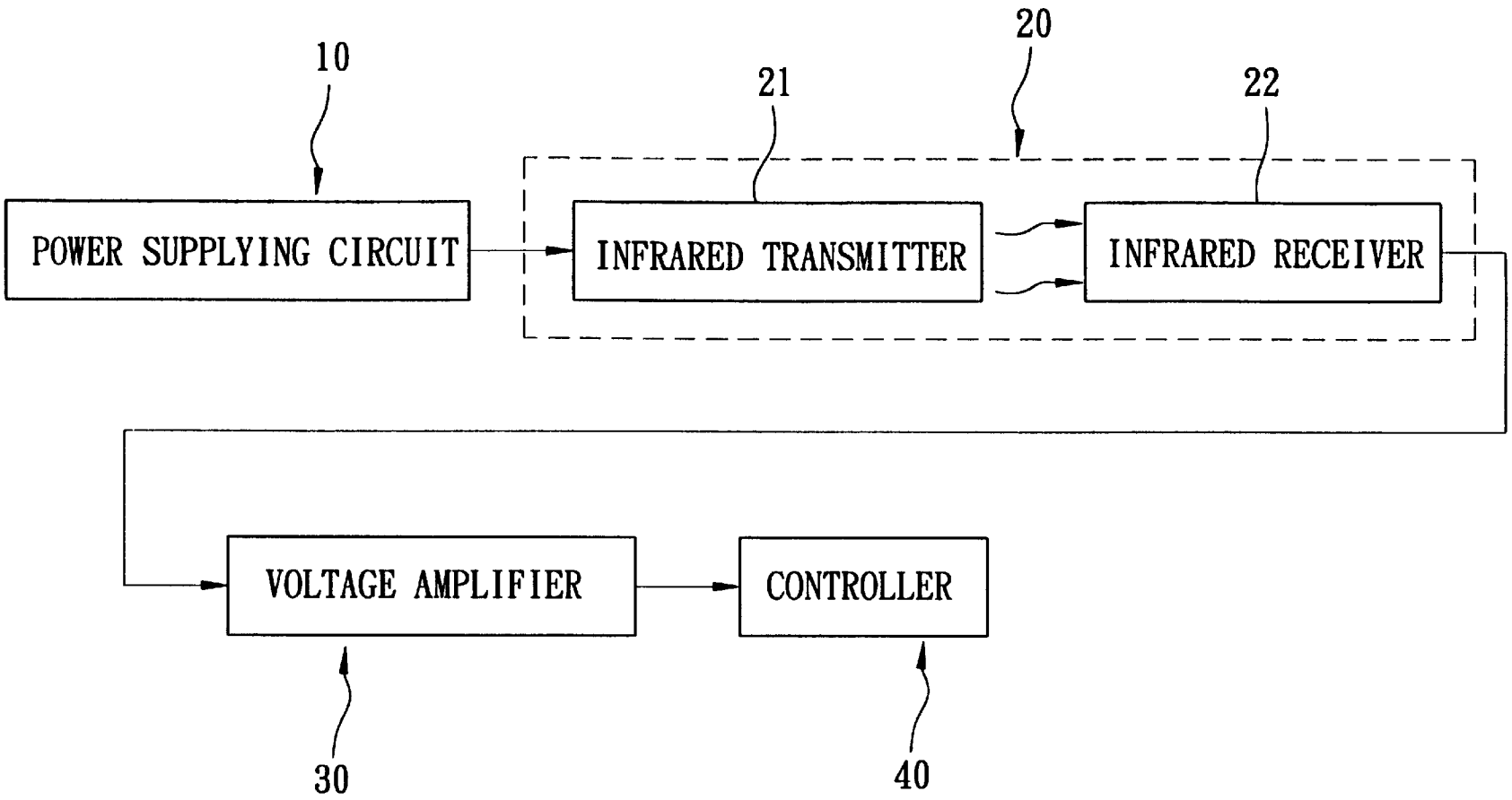
FIG. 3 is a block diagram of the preferred embodiment of a label-sensing device according to the present invention.
Figure 4:
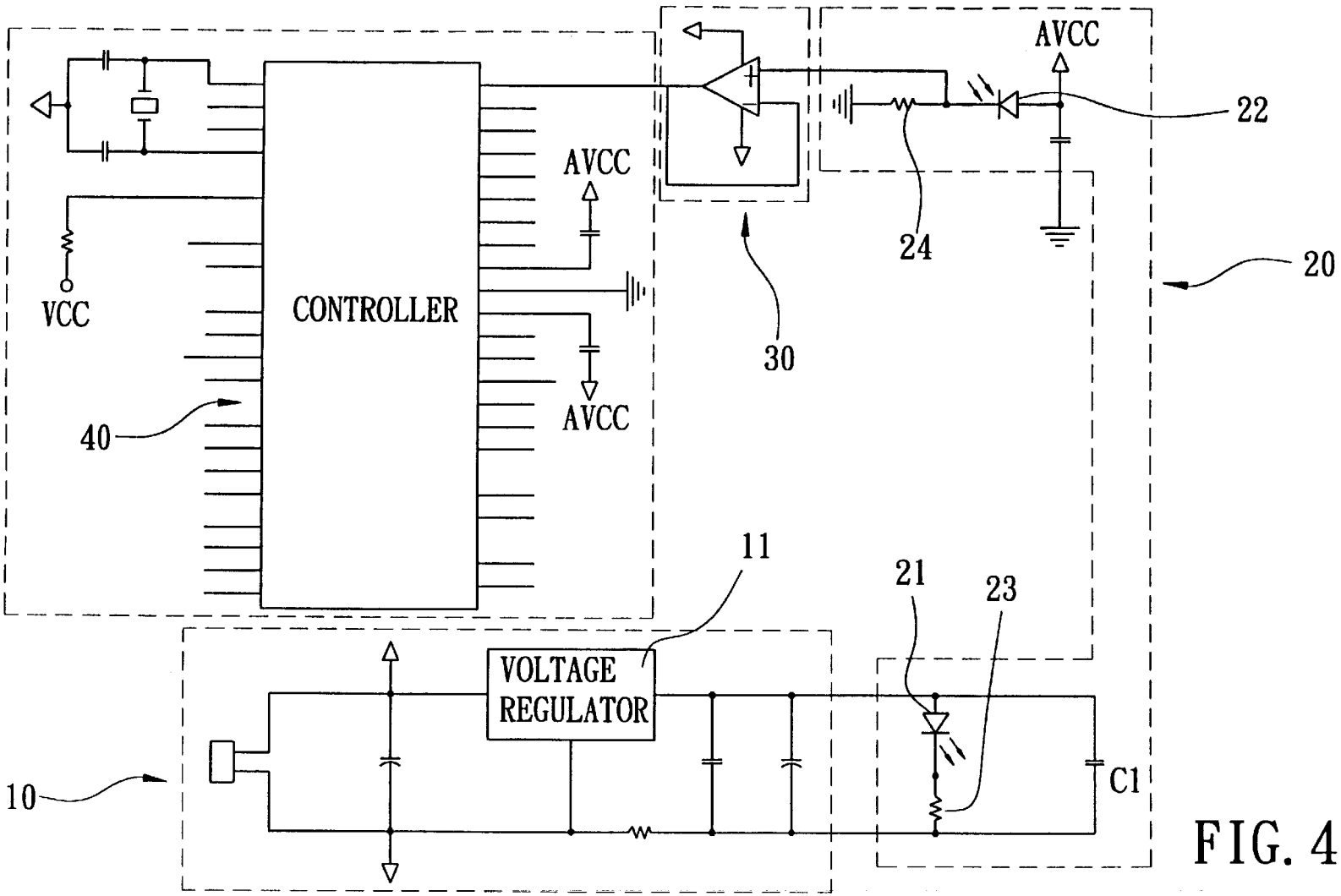
FIG. 4 is a schematic electrical circuit diagram of the preferred embodiment.

Referring to FIGS. 3 and 4, the preferred embodiment of a label-sensing device according to the present invention is shown to comprise a power supplying circuit 10, an infrared sensor 20 coupled to the power supplying circuit 10, a voltage amplifier 30 coupled to the infrared sensor 20, and a controller 40 coupled to the voltage amplifier 30.

The power supplying circuit 10 includes a voltage regulator 11, and supplies a predetermined regulated DC voltage output.

The infrared sensor 20 includes an infrared diode transmitter 21 connected in series to a resistor 23. The series combination of the transmitter 21 and the resistor 23 are connected in parallel to the power supplying circuit 10 and to a capacitor C1. The transmitter 21 generates a sensing light output with an intensity that corresponds to the regulated DC voltage output. The infrared sensor 20 further includes an infrared diode receiver 22 connected in series to a resistor 24. A detected output from the infrared sensor 20 is obtained from the junction of the receiver 22 and the resistor 24.

Figure 5:
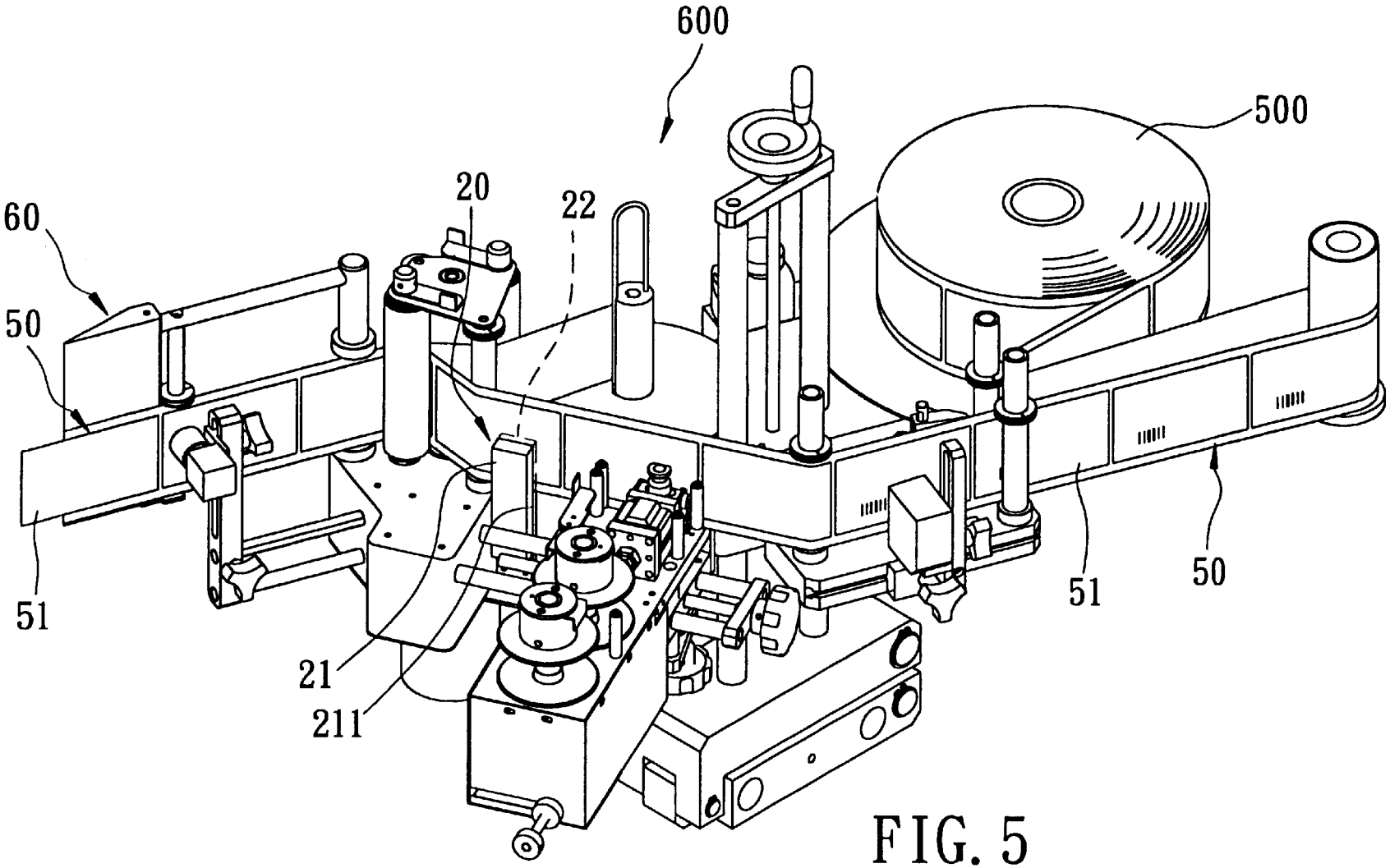
FIG. 5 is a perspective view showing a labeling machine that incorporates the preferred embodiment.

In practice, as shown in FIG. 5, the sensing light output from the transmitter 21 is directed to pass through one end of a label reel 500, that is being fed by a labeling machine 600 through a clearance 211 that is formed between the transmitter 21 and the receiver 22, before being received by the receiver 22. The label reel 500 includes a backing paper strip 50 and a plurality of labels 51 releasably and successively adhered on the backing paper strip 50. The detected output at the receiver 22 has a weaker first intensity upon detection of first portions of the label reel 500 where the labels 51 overlap with the backing paper strip 50, and a stronger second intensity upon detection of second portions of the label reel 500 where the labels 51 do not overlap with the backing paper strip 50, e.g. at a clearance between each adjacent pair of the labels 51 on the backing paper strip 51. Of course, the magnitudes of the first and second intensities are affected by the physical characteristics, e.g. paper quality, thickness and transparency, of the backing paper strip 50 and the labels 51.

The voltage amplifier 30 is connected to the junction of the receiver 22 and the resistor 24, and amplifies the detected output from the infrared sensor 20 in a conventional manner. Thus, the voltage amplifier 30 generates a first signal when the detected output has the first intensity, and a second signal when the detected output has the second intensity.

The controller 40 receives the first and second signals from the voltage amplifier 30. When operated in an initialization mode, the controller 40 converts the first signal into a 12-bit first detected value, and further converts the second signal into a 12-bit second detected value. The controller 40 then determines an initial reference value between the first and second detected values. Thus, when the controller 40 is operated in a normal mode, the controller 40 is able to determine whether the detected portion of the label reel 500 is one where the labels 51 overlap with the backing paper strip 50 when the detected value for the signal from the amplifier 30 is lower than the initial reference value, or one where the labels 51 do not overlap with the backing paper strip 50 when the detected value for the signal from the amplifier 30 is higher than the initial reference value. For example, assuming that the initial reference value is set at 300, if the detected value is 250, this indicates that the detected portion of the label reel 500 is one where the labels 51 overlap with the backing paper strip 50, and if the detected value is 600, this indicates that the detected portion of the label reel 500 is one where the labels 51 do not overlap with the backing paper strip 50.

The controller 40 samples the signal from the amplifier 30 at a rate of about 25000 times per second. In the event of a change in the ambient light condition, the initial reference value might have to be adjusted so that the initial reference value is between the detected values for the different portions of the label reel 500 in order to achieve accurate detection of the movement of the label reel 500. In other words, upon detection by the controller 40 that the initial reference value is lower than the first detected value, the initial reference value is adjusted to a new value higher than the first detected value. Accordingly, upon detection by the controller 40 that the initial reference value is higher than the second detected value, the initial reference value is adjusted to a new value lower than the second detected value.

With the inclusion of the label-sensing device of this invention in a labeling machine, the leading edges of the labels 51 on the label reel 500 can be accurately positioned with respect to a label applicator plate 60 when attaching the labels 51 to containers (not shown).

Unlike the conventional label-sensing device described beforehand, the intensity of the sensing light output from the infrared transmitter 21 is constant since the latter is driven by a regulated DC voltage output from the power supplying circuit 10. In addition, the controller 40, which continuously samples the signal from the amplifier 30, is capable of adjusting a reference value therein to ensure that the latter is between the detected values for different portions of the label reel 500 in order to compensate for changes in the ambient light condition and to achieve accurate detection of the movement of the label reel 500.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A label-sensing device adapted for use in a labeling machine to detect movement of a label reel during a label-feeding operation of the machine, the label reel including a backing paper strip and a plurality of label reels releasably and successively adhered on the backing paper strip, said label-sensing device comprising:

a power supplying circuit adapted to supply a predetermined regulated DC voltage output;

an infrared sensor including an infrared transmitter coupled to said power supplying circuit, and an infrared receiver that forms a clearance with said infrared transmitter, said clearance being adapted to permit passage of one end of the label reel therethrough, said transmitter generating a sensing light output with an intensity that corresponds to the regulated DC voltage output, the sensing light output being directed by said transmitter so as to be adapted to pass through said one end of the label reel before being received by said receiver, said receiver having a detected output with a weaker first intensity upon detection of a first portion of the label reel where one of the labels overlaps with the backing paper strip, and with a stronger second intensity upon detection of a second portion of the label reel where the labels do not overlap with the backing paper strip;

a voltage amplifier coupled to said receiver for amplifying the detected output, said voltage amplifier generating a first signal when the detected output has the first intensity, and a second signal when the detected output has the second intensity; and a controller coupled to said voltage amplifier, said controller converting the signal from said voltage amplifier into a corresponding detected value, and comparing the detected value with an initial reference value to determine whether the first portion or the second portion of the label reel has passed through said clearance of said infrared sensor.

2. The label-sensing device of claim 1, wherein said controller automatically adjusts the initial reference value to be higher than the detected value corresponding to the first signal from said voltage amplifier upon detection by said controller that the initial reference value is lower than the detected value for the first signal, and to be lower than the detected value corresponding to the second signal from said voltage amplifier upon detection by said controller that the initial reference value is higher than the detected value for the second signal.

* * * * *